US006694763B2

(12) United States Patent
Howard

(10) Patent No.: US 6,694,763 B2
(45) Date of Patent: Feb. 24, 2004

(54) METHOD FOR OPERATING A TRANSCRITICAL REFRIGERATION SYSTEM

(75) Inventor: Henry Edward Howard, Grand Island, NY (US)

(73) Assignee: Praxair Technology, Inc., Danbury, CT (US)

( * ) Notice: Subject to any disclaimer, the term of this patent is extended or adjusted under 35 U.S.C. 154(b) by 23 days.

(21) Appl. No.: 10/156,804

(22) Filed: May 30, 2002

(65) Prior Publication Data

US 2003/0221435 A1 Dec. 4, 2003

(51) Int. Cl.[7] ..... F25B 49/00
(52) U.S. Cl. ..... 62/228.3; 62/115; 62/176.3
(58) Field of Search ..... 62/228.3, 115, 62/176.3, 176.6, 226, 228.1, 312

(56) References Cited

U.S. PATENT DOCUMENTS

| | | | | |
|---|---|---|---|---|
| 5,245,836 A | | 9/1993 | Lorentzen et al. | 62/174 |
| 5,497,631 A | | 3/1996 | Lorentzen et al. | 62/115 |
| 5,655,378 A | | 8/1997 | Pettersen | 62/174 |
| 5,685,160 A | * | 11/1997 | Abersfelder et al. | 62/114 |
| 6,105,380 A | * | 8/2000 | Yokomachi et al. | 62/228.3 |
| 6,105,386 A | | 8/2000 | Kuroda et al. | 62/513 |
| 6,182,456 B1 | | 2/2001 | Yamaguchi et al. | 623/222 |
| 6,298,674 B1 | * | 10/2001 | Finkenberger et al. | 62/115 |
| 6,385,981 B1 | * | 5/2002 | Vaisman | 62/196.3 |
| 6,418,735 B1 | * | 7/2002 | Sienel | 62/115 |

OTHER PUBLICATIONS

Operation of Trans–Critical $CO_2$ Vapour Compression Circuits In Vehicle Air Conditioning—Pettersen et al., IIR Refrigeration Science And Technology Proceedings, May 10, 1994, pp. 495–501.

Control Strategies For Transcritical R744 Systems—McEnamey et al., SAE, 1999.

A Correlation Of Optimal Heat Rejection Pressures In Transcritical Carbon Dioxide Cycles—Liao et al., Applied Thermal Engineering 20, (2000), 831–844.

* cited by examiner

*Primary Examiner*—Melvin Jones

(57) ABSTRACT

A method for operating a transcritical refrigeration system wherein a more optimal compressor parameter such as output pressure, pressure ratio or power consumption is determined using heat exchanger refrigerant inflow temperatures and/or outflow temperatures and also the enthalpy change across the evaporator and adjusting the compressor operation or refrigerant fluid working mass accordingly.

16 Claims, 2 Drawing Sheets

METHOD FOR OPERATING A TRANSCRITICAL REFRIGERATION SYSTEM

TECHNICAL FIELD

This invention relates generally to transcritical refrigeration systems and, more particularly, to control systems for transcritical refrigeration systems.

BACKGROUND ART

A transcritical refrigeration system or cycle is one where the high side pressure of the refrigerant fluid exceeds the critical pressure of the refrigerant fluid and the low side pressure of the refrigerant fluid is less than the critical pressure of the refrigerant fluid. Transcritical refrigeration systems are increasing in importance. For example, carbon dioxide has received increasing consideration for use as a refrigerant. Some of the advantages provided by carbon dioxide include lower toxicity, zero ozone depletion potential and negligible direct global warming impact. Application of carbon dioxide as a working fluid for automobile air conditioning systems has received considerable commercial attention. In particular, it is anticipated that carbon dioxide will substantially displace the use of R134a in new automobiles over the next 5 to 10 years. Typical heat rejection temperatures for air conditioning systems designed for comfort cooling will exceed the critical temperature of carbon dioxide (87.8° F., 1066.3 psia) The rejection of process heat to the environment necessitates that the condenser (or more appropriately the gas cooler) pressure exceed the critical pressure. Since typical evaporation temperatures (40° F.) lie below the critical temperature of carbon dioxide the overall cycle is transcritical.

The design and operation of transcritical refrigeration or heat pump cycles pose a unique optimization and control problem. In general, the desired evaporator temperature and/or heat load is known. Typically the ambient utility (water/air) conditions used for heat rejection is also known. In a standard vapor compression cycle, the high side pressure is set by the condition of achieving a saturated or subcooled liquid at the exit of the condenser. In a transcritical cycle, the high side pressure may be selected from a broad range. Unfortunately, only one point of operation will result in minimum power consumption. Given the cited parameters, the objective of any transcritical process control strategy must be to identify the optimal pressure and to drive the process toward it. During actual process operation most systems may deviate substantially from the design load and utility conditions (air-water temperature). In such situations, the power consumption may be 5–10% higher than necessary if the high-side pressure is not adjusted appropriately. Most control systems cannot readily extract this additional process efficiency because they are incapable of adequately determining the optimal high side pressure. Current approaches to this problem rely upon rudimentary techniques such as manual trial and error or complicated heuristics.

Accordingly it is an object of this invention to provide an improved method for operating a transcritical refrigeration system.

SUMMARY OF THE INVENTION

The above and other objects, which will become apparent to those skilled in the art upon a reading of this disclosure, are attained by the present invention, one aspect of which is:

A method for operating a transcritical refrigeration system comprising:

(A) compressing a refrigerant fluid in a compressor to be at a supercritical pressure, passing the compressed refrigerant fluid to a heat exchanger, cooling the compressed refrigerant fluid in the heat exchanger, withdrawing the cooled compressed refrigerant fluid from the heat exchanger, and expanding the resulting refrigerant fluid to a subcritical pressure, said subcritical pressure refrigerant fluid being at least in part in liquid form;

(B) vaporizing subcritical pressure refrigerant fluid to provide refrigeration to a heat load, passing vaporized refrigerant fluid to the heat exchanger, warming the vaporized refrigerant fluid by indirect heat exchange with the cooling compressed refrigerant fluid, withdrawing the resulting warmed refrigerant fluid from the heat exchanger, and passing the withdrawn refrigerant fluid to the compressor;

(C) ascertaining at least two of the two inlet temperatures of the refrigerant fluid passed into the heat exchanger and the two outlet temperatures of the refrigerant fluid withdrawn from the heat exchanger, and ascertaining the enthalpy change of the vaporizing subcritical pressure refrigerant;

(D) monitoring an operating parameter of the compressor, and using the said ascertained temperatures and the said ascertained enthalpy change to determine a more efficient value for said operating parameter; and (E) adjusting the operation of the compressor so that the value of said operating parameter is closer to the said more efficient value.

Another aspect of the invention is:

A method for operating a transcritical refrigeration system comprising:

(A) compressing a refrigerant fluid in a compressor to be at a supercritical pressure, passing the compressed refrigerant fluid to a heat exchanger, cooling the compressed refrigerant fluid in the heat exchanger, withdrawing the cooled compressed refrigerant fluid from the heat exchanger, and expanding the resulting refrigerant fluid to a subcritical pressure said subcritical pressure refrigerant fluid being at least in part in liquid form;

(B) vaporizing subcritical pressure refrigerant fluid to provide refrigeration to a heat load, passing vaporized refrigerant fluid to the heat exchanger, warming the vaporized refrigerant fluid by indirect heat exchange with the cooling compressed refrigerant fluid, withdrawing the resulting warmed refrigerant fluid from the heat exchanger, and passing the withdrawn refrigerant fluid to the compressor;

(C) ascertaining at least two of the two inlet temperatures of the refrigerant fluid passed into the heat exchanger and the two outlet temperatures of the refrigerant fluid withdrawn from the heat exchanger, and ascertaining the enthalpy change of the vaporizing subcritical pressure refrigerant;

(D) monitoring an operating parameter of the compressor, and using the said ascertained temperatures and the said ascertained enthalpy change to determine a more efficient value for said operating parameter; and (E) adjusting the working mass of the refrigerant fluid so that the value of said operating parameter is closer to the said more efficient value.

As used herein the term "working mass" means the portion of the refrigerant fluid within the compressor, expansion device, process heat exchanger, and associated interconnecting piping of the refrigeration system. Another way of defining the working mass of the refrigerant is as the integrated volume of refrigerant fluid being actively passed through the compressor, i.e. the volume of refrigerant fluid that is passed through the compressor in the time it takes for a refrigerant fluid molecule to make one complete pass through the refrigeration system or refrigeration circuit.

As used herein the term "critical pressure" means the pressure of a fluid at which the liquid and vapor phases can no longer be differentiated.

As used herein the term "critical temperature" means the temperature of a fluid above which a distinct liquid phase can no longer be formed regardless of pressure.

As used herein the term "enthalpy" means a thermodynamic measure of heat content per unit mass.

DETAILED DESCRIPTION

In general, the invention involves monitoring the value of an operating parameter of the compressor in a refrigeration cycle, such as for example the output pressure, the pressure ratio or the power consumption of the compressor, and adjusting either the operation of the compressor or the working mass of the refrigerant fluid in the refrigeration cycle to improve the value of that operating parameter so that it is closer to a determined more efficient value.

Figure 1:
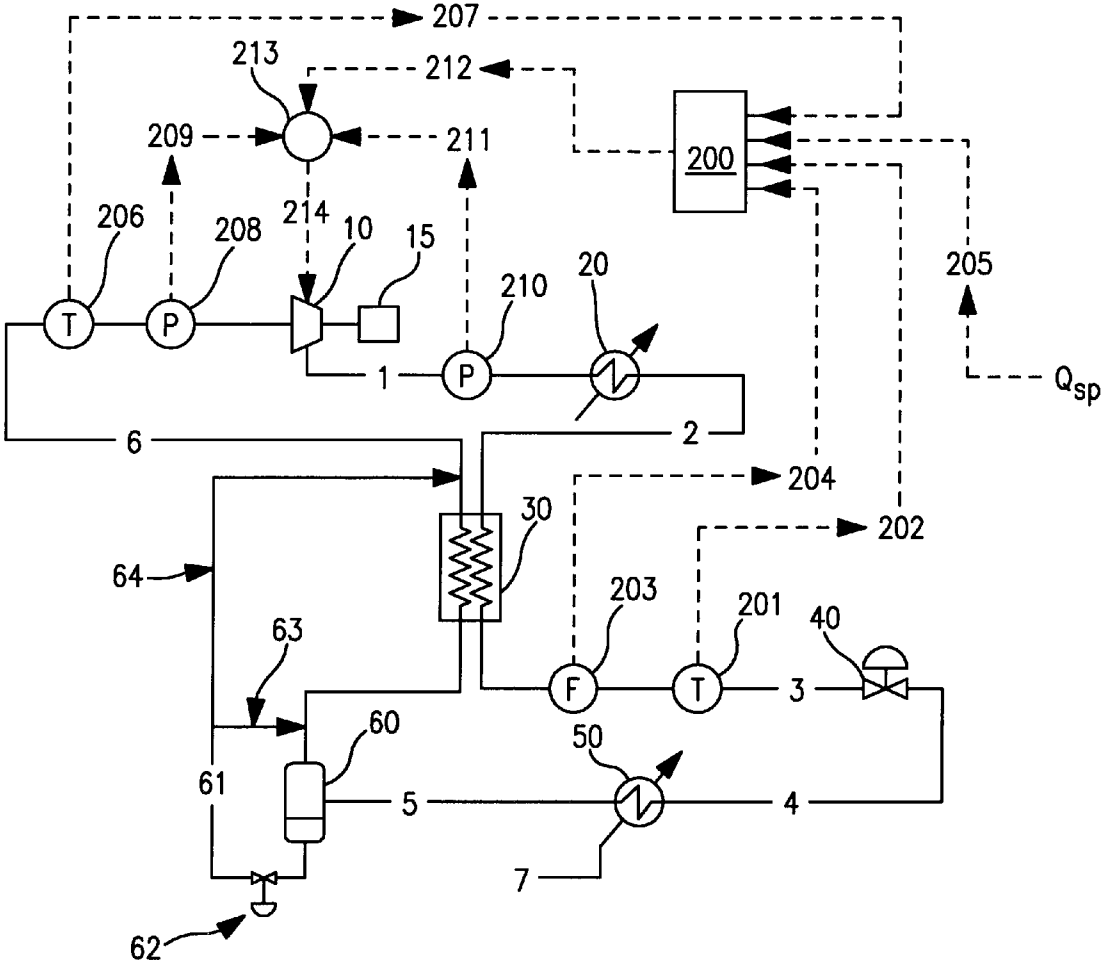
FIG. 1 is a schematic representation of one embodiment of an arrangement which may be used in a preferred practice of this invention wherein the temperatures of the refrigerant fluids withdrawn from the heat exchanger are ascertained.

The invention will be described in detail with reference to the Drawings. Referring now to FIG. 1, the process shown is a transcritical refrigeration cycle employing both a suction line heat exchanger 30 and a low-side receiver 60. The control technique used to illustrate the invention is based upon a cascade control system. Numerous variations to the basic flowsheet may be possible without impacting the efficacy of the invention.

Compressor 10 serves to pressurize a refrigerant fluid stream 1 to a pressure in excess of the critical pressure of the fluid. Compressor 10 may be driven by external means 15 which may be an electrical motor or a belt driven shaft powered by an internal combustion engine or by the shaft work generated by expansion of another fluid. Compressor 10 may be selected from a variety of machines including reciprocating, centrifugal, scroll or rolling piston machines. After compression, refrigerant stream 1 is cooled in heat exchanger 20 by a suitable ambient utility (air/water). The cooled super-critical refrigerant stream 2 is further cooled in heat exchanger 30 (internal or suction line heat exchanger). If desired, heat exchangers 20 and 30 may be combined in a single unit. Stream 3 is subsequently expanded to a pressure below the critical pressure of the fluid through valve 40. Valve 40 may be of several types including but not limited to thermo-static and electrically driven control valves. Such valves may be equipped with local control logic (not shown) by which the valve opening is controlled in order to establish a given level of superheat at stream 5. As stream 3 expands, it cools and forms a two-phase mixture 4. Refrigerant stream 4 is then substantially vaporized in heat exchanger 50. The heat of vaporization serves to absorb the external heat load. An external process stream 7 is cooled in heat exchanger 50. Stream 7 may be any number of fluids including air, water or other process fluid. Stream 5 exiting evaporator 50 is substantially gas. Receiver 60 serves to separate any excess liquid or lubricant oil that may pass through evaporator 50. These liquids may be returned to the process by way of valve 62 through line 61 and either lines 63 or 64. The vapor from receiver 60 is further warmed in heat exchanger 30 to a temperature substantially above saturation. The superheated refrigerant stream 6 is subsequently directed back to compressor 10 and the refrigeration cycle starts anew.

In reference to the cycle shown in FIG. 1 with carbon dioxide as the refrigerant fluid, the discharge of compressor 10 will generally range between 1100 to 2000 pounds per square inch absolute (psia). The pressure at the exit of expansion valve 40 will generally range between 200 and 700 psia. The temperature at the exit of expansion valve 40 will generally range between −25 to 55° F.

The invention may be characterized by the use of selected process parameters that have been determined to be particularly effective in ascertaining the optimal compression ratio. In particular, determination of the optimal high side pressure control setpoint requires at least two temperatures associated with either the inlet or the outlet of the internal heat exchanger 30 as well as a measure of the observed or desired enthalpy change across the evaporator 50.

Flow element 203 obtains a measurement of refrigerant flow at the high-pressure discharge of internal heat exchanger 30, stream 3. This flow measurement is directed by electronic signal 204 to control means 200. Similarly, a temperature element 201 obtains a temperature measurement from stream 3 at a nearby location and directs signal 202 to process controller 200. Temperature element 206 obtains a temperature measurement from stream 6 and directs a proportional signal 207 to controller 200. The desired capacity or known heat load represented by $Q_{sp}$ is also directed as input by signal 205 to controller 200. The desired refrigeration capacity $Q_{sp}$ may be specified directly or indirectly. Control inputs 205, 202, 204 and 207 are used to compute either the compression ratio or the high side pressure necessary to minimize the power consumed by compressor 10. Although not shown, controller means 200 may employ known thermodynamic constants specific to the refrigerant fluid, which may aid in the calculation of the optimal high side pressure. An operating parameter, such as pressure, pressure ratio or power consumption, setpoint signal 212 is generated from control means 200 and directed to local control means 213. Controller 213 may be local to the compressor and serves to govern the operation of compressor 10. Alternatively controller 213 may be used to adjust the refrigerant contained-sequestered in surge vessel 60. Pressure elements 208 and 210 measure the pressure from streams 6 and 1, respectively. Alternatively the pressures from points 5 and 3 could also be used. Signals 209 and 211 are generated in response to these measurements and are directed to controller means 213. Controller means 213 generates a signal 214, which directs the operation of compressor 10 in order that the value of the operating parameter of the compressor approaches the desired optimal setpoint provided by signal 212 from controller 200. Local control means 213 may be integrated with setpoint targeting controller 200.

The following example is based upon the transcritical cycle shown in FIG. 1. The following example illustrates a possible calculation by which process controller 200 might utilize the recited process signals/inputs. The following example is only representative of the subject calculation. It is not the only technique by which the recited observables can be used to control the process. For purposes of illustration, the compressor efficiency has been assumed constant. Assuming non-constant compressor efficiency does not change the non-dimensional parameters.

Several physical parameters have proven useful to the operation of controller means 200. Calculation of the adiabatic compression power requires the ratio of_heat capacity ($k=C_p/C_v$). For many refrigerants, k may be assumed constant over a broad range of conditions. A particularly useful form is shown below.

$$\gamma = \frac{k-1}{k}$$

By taking the equation for adiabatic compression_power and differentiating it, the condition for optimal control may be obtained. The combination of this relation with the differentiated forms of real gas enthalpy and compressibility results in two non-dimensional parameters ($\Phi$ and $\psi$) that effectively characterizes the operation of the transcritical cycle.

$$Pr^{\gamma}+(Pr^{\gamma}-1(\Phi+\Psi)=0$$

Where $\Phi$ and $\psi$ are defined by the following relations.

$$\Phi = \left[\frac{RT_3^2}{\gamma(h_5-h_3)}\right]\left[\frac{\partial Z}{\partial T}\right]_3$$

$$\Psi = \left(\frac{T_3}{T_6}\right)\left[\frac{C_{ph}}{\gamma C_{pl}}\right]\left(1-\left[\frac{\partial \ln Z}{\partial \ln P}\right]_3\right)$$

The subscripts refer to the stream labels shown in the Figure. R is the ideal gas constant. T, Pr and h represent temperature, pressure ratio and enthalpy, respectively. Z represents real gas compressibility. $C_{ph}$ and $C_{pl}$ represent the mean heat capacity of the high and low-pressure sides of internal heat exchanger 30, respectively. Both the ratio of $C_p$ and $\gamma$ are relatively insensitive to the operation of the cycle shown in the Figure and may be treated as constants. By experience it has also been shown that detailed knowledge of the compressibility derivatives is not necessary. In most instances, these quantities may be taken as constants or used as tuning parameters. In equation 3, the enthalpy difference across the refrigerant evaporator is shown. The load setpoint $Q_{sp}$ can be used to calculate the desired refrigerating effect of the system. The enthalpy difference may be computed by dividing $Q_{sp}$ (signal 205) by the instantaneous mass flowrate of the refrigerant (signal 203). Temperatures $T_3$ and $T_6$ are shown in the Figure as signals 202 and 207 respectively. The highlighted observables enable the calculation of the non-dimensional parameters. Subsequent solution of equation 2 provides the optimal compression ratio. The optimal compression ratio may be used as the setpoint for controller 213 or may be converted directly into a high side pressure by multiplying the pressure found in stream 6 or signal 209.

The invention is non-specific to the nature of the refrigerant or working fluid. Examples of potential transcritical refrigerant fluids include: $CO_2$, $C_2H_6$, $N_2O$, $B_2H_6$ and $C_2H_4$. Furthermore, the process is applicable to cycles in which the supercritical gas cooling occurs at sub-ambient temperatures. The gas cooling heat load may be rejected to some other process fluid or refrigerant. Alternatively, the transcritical cycle may be operated in a heat pump mode where, for instance, water is heated in gas cooler 20 and the operating temperature of evaporator 50 is controlled in response to ambient conditions.

By ascertaining, it is herein meant any method of obtaining, calculating or inferring the subject quantities. As an example, process pressure 208 can be inferred from knowledge of the saturation temperature at streams 4 and 5 via the integrated form of the Clapeyron Equation. Likewise, compressor power consumption may be computed directly from the voltage and current absorbed by the corresponding motor or it may be calculated given the pressures (and other physical parameters, flow, heat capacity, etc.) In addition, ascertaining can mean a value obtained or specified by an external source or user. For example, one can specify that the temperature at 4/5 (evaporator) be maintained at a certain level.

If the system is specified to operate at a given evaporation temperature, the user input $Q_{sp}$ (desired capacity) may be replaced by the current heat load. For instance if air is the cooled stream in exchanger 50, the load may be calculated using the known flow and temperature change. The enthalpy change term shown in equation 3 may be computed by dividing the computed heat load by the mass flow of the refrigerant (measurement 203, 204). In the preferred embodiment, the user specifies the load (capacity setpoint) for the refrigeration system $Q_{sp}$ and the enthalpy term of equation 3 is computed directly by dividing the load setpoint by the mass flow of refrigerant.

Process control means 200 may comprise a pre-programmed logic controller or a stand-alone computer with suitable algorithms for continues process control. Unit operation control may be performed using conventional PID control or through the use of model predictive control. Signals to and from the controller are preferably electrical signals, however it is known that such signals may be conveyed pneumatically, mechanically or otherwise. Although controllers 200 and 213 are shown as separate entities, the calculations may be integrated together.

Inspection of the key non-dimensional parameters indicates that several thermodynamic quantities may be incorporated into the control strategy. Such information may comprise compressibility data or similar information obtained from an equation of state. Such tables or equations may be incorporated into the calculation. Inspection of Equation 4 indicates that the ratio of mean heat capacity for either side of internal heat exchanger 30 is used to compute non-dimensional parameter $\psi$. It is known from a heat balance around internal heat exchanger 30 that Cp may be replaced by a function based upon exchanger UA. Alternatively, the ratio of heat capacities may be replaced by use of all inlet and outlet temperatures surrounding heat exchanger 30. Equation 2 is shown in terms of pressure ratio due to the fact that a fully non-dimension equation form is preferred. The equation may be reworked in terms of high-side pressure. Low side pressure may be obtained directly from a pressure measurement or inferentially by saturation temperature as previously discussed.

An important alternative to the preferred implementation stems from alternate uses of the same preferred observables. Equation 2 may be arranged into an objective function for an online optimization/control strategy. An additional process signal from motor 15 (not shown) indicative of the consumed power may be directed to controller 200 in order to provide additional feedback to the calculation.

The subject control strategy need not adjust the compressor directly. Alternatively, control means 200 and output signal/setpoint 212 may control the level setpoint for receiver 60 or a separate refrigerant control volume. Although the non-dimensional parameters shown in Equations 3 and 4 represent a preferred route to implementation, they can be used in an objective function that adjusts several unit operations simultaneously.

Figure 2:
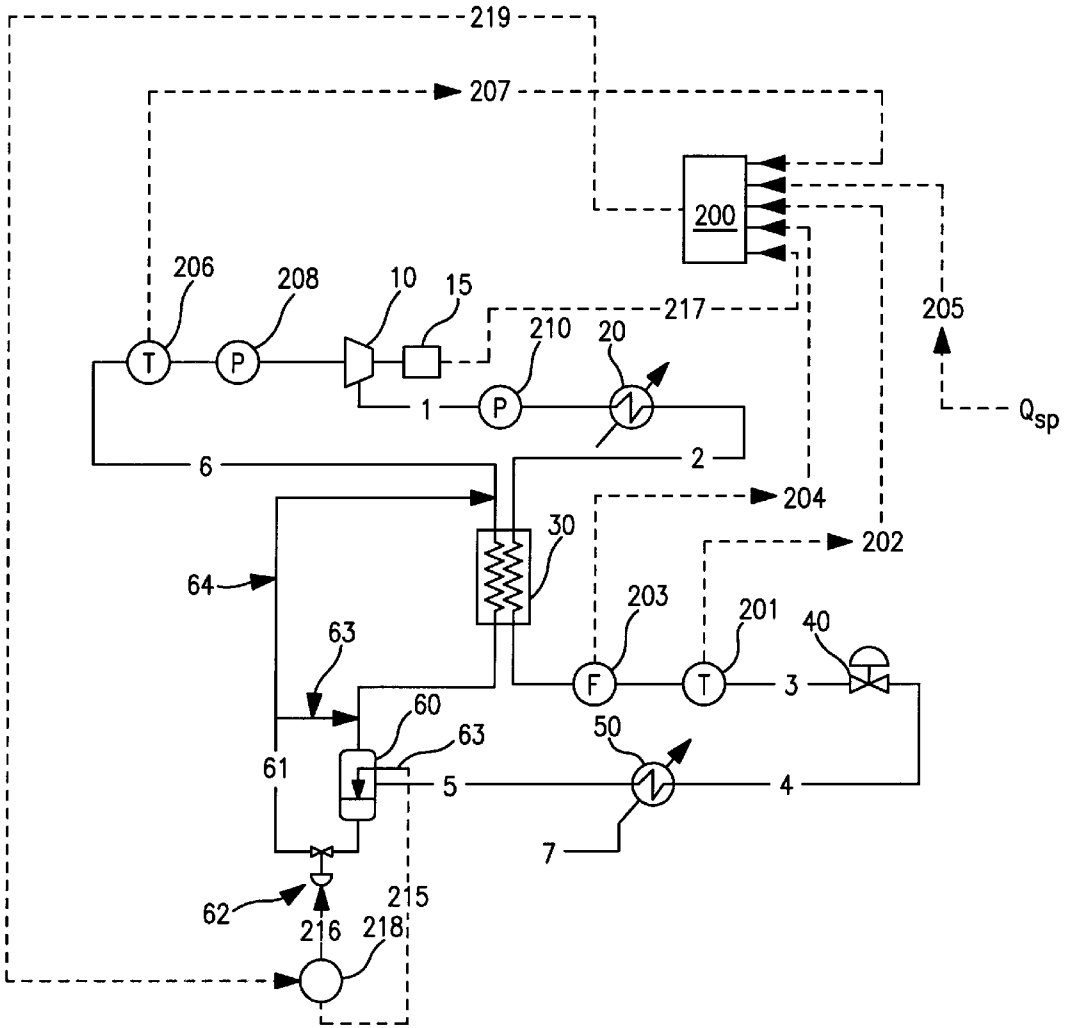
FIG. 2 is a schematic representation of another embodiment of an arrangement which may be used in a preferred practice of the invention wherein the working mass of the refrigerant being passed to the compressor is adjusted to improve the operation of the compressor by changing the amount of refrigerant sequestered within the refrigeration cycle.

FIG. 2 illustrates another embodiment of the invention wherein the monitored operating parameter of the compressor is the power consumption. In this embodiment illustrated in FIG. 2 the power consumption of the compressor is monitored and changed by adjusting the working mass of the refrigerant fluid in the refrigeration system. The numerals in FIG. 2 are the same as those of FIG. 1 for the common elements and these common elements will not be described again in detail.

Referring now to FIG. 2, a measure of the energy consumed by compressor 10 is directed by electronic signal 217 to controller 200. Controller 200 serves to generate a set point for the liquid level in vessel 60 which is passed to controller 218 by electrical signal 219. A measure of the volume of refrigerant fluid sequestered in vessel 60 is obtained from level sensor 63 which is subsequently directed by electronic signal 215 to local control element 218. Controller 218 generates a control signal 216 which adjusts the flow of liquid refrigerant fluid from vessel 60 by adjusting control valve 62, thereby changing the power consumption of compressor 10 toward a more efficient or optimum value.

There are a number of important alternatives relative to the above steps. Foremost among these alternatives is the potential integration of the internal heat exchanger and the load exchanger into a single exchanger. Exchangers that can be adapted to such service include plate and frame, plate fin and shell and tube exchangers. Expansion valve 40 may be replaced by a turboexpander with the production of useful work. The refrigerant flowing through the gas cooler may release its heat to any number of external streams including but not limited to air, water or other refrigerants.

What is claimed is:

1. A method for operating a transcritical refrigeration system comprising:

(A) compressing a refrigerant fluid in a compressor to be at a supercritical pressure, passing the compressed refrigerant fluid having a temperature to a heat exchanger, cooling the compressed refrigerant fluid in the heat exchanger, withdrawing the cooled compressed refrigerant fluid having a temperature from the heat exchanger, and expanding the resulting refrigerant fluid to a subcritical pressure, said subcritical pressure refrigerant fluid being at least in part in liquid form;

(B) vaporizing subcritical pressure refrigerant fluid to provide refrigeration to a heat load said vaporizing subcritical pressure refrigerant fluid having an enthalpy change, passing vaporized refrigerant fluid having a temperature to the heat exchanger, warming the vaporized refrigerant fluid by indirect heat exchange with the cooling compressed refrigerant fluid, withdrawing the resulting warmed refrigerant fluid having a temperature from the heat exchanger, and passing the withdrawn refrigerant fluid to the compressor;

(C) ascertaining at least two of the temperature of the compressed refrigerant fluid, temperature of the cooled compressed refrigerant fluid, temperature of the vaporized refrigerant fluid, and temperature of the warmed refrigerant fluid, and ascertaining the enthalpy change of the vaporizing subcritical pressure refrigerant;

(D) monitoring an operating parameter of the compressor, and using the said ascertained temperatures and the said ascertained enthalpy change to determine a more efficient value for said operating parameter; and (E) adjusting the operation of the compressor so that the value of said operating parameter is closer to the said more efficient value.

2. The method of claim 1 wherein the operating parameter is the output pressure of the refrigerant fluid from the compressor.

3. The method of claim 1 wherein the operating parameter is the pressure ratio of the pressure of the refrigerant fluid passed out from the compressor and the pressure of the refrigerant fluid passed into the compressor.

4. The method of claim 1 wherein the operating parameter is the power consumption of the compressor.

5. The method of claim 1 wherein the refrigerant fluid comprises carbon dioxide.

6. The method of claim 5 wherein the supercritical pressure is within the range of from 1100 to 2000 psia and the subcritical pressure is within the range of from 200 to 700 psia.

7. The method of claim 1 wherein the enthalpy change is ascertained using a specified heat load.

8. The method of claim 1 wherein the enthalpy change is ascertained using the actual heat load.

9. A method for operating a transcritical refrigeration system comprising:

(A) compressing a refrigerant fluid having a working mass in a compressor to be at a supercritical pressure, passing the compressed refrigerant fluid having a temperature to a heat exchanger, cooling the compressed refrigerant fluid in the heat exchanger, withdrawing the cooled compressed refrigerant fluid having a temperature from the heat exchanger, and expanding the resulting refrigerant fluid to a subcritical pressure said subcritical pressure refrigerant fluid being at least in part in liquid form;

(B) vaporizing subcritical pressure refrigerant fluid to provide refrigeration to a heat load said vaporizing subcritical pressure refrigerant fluid having an enthalpy change, passing vaporized refrigerant fluid having a temperature to the heat exchanger, warming the vaporized refrigerant fluid by indirect heat exchange with the cooling compressed refrigerant fluid, withdrawing the resulting warmed refrigerant fluid having a temperature from the heat exchanger, and passing the withdrawn refrigerant fluid to the compressor;

(C) ascertaining at least two of the temperature of the compressed refrigerant fluid, temperature of the cooled compressed refrigerant fluid, temperature of the vaporized refrigerant fluid, and temperature of the warmed refrigerant fluid, and ascertaining the enthalpy change of the vaporizing subcritical pressure refrigerant;

(D) monitoring an operating parameter of the compressor, and using the said ascertained temperatures and the said ascertained enthalpy change to determine a more efficient value for said operating parameter; and (E) adjusting the working mass of the refrigerant fluid so that the value of said operating parameter is closer to the said more efficient value.

10. The method of claim 9 wherein the operating parameter is the output pressure of the refrigerant fluid from the compressor.

11. The method of claim 9 wherein the operating parameter is the pressure ratio of the pressure of the refrigerant fluid passed out from the compressor and the pressure of the refrigerant fluid passed into the compressor.

12. The method of claim 9 wherein the operating parameter is the power consumption of the compressor.

13. The method of claim 9 wherein the refrigerant fluid comprises carbon dioxide.

14. The method of claim 13 wherein the supercritical pressure is within the range of from 1100 to 2000 psia and the subcritical pressure is within the range of from 200 to 700 psia.

15. The method of claim 9 wherein the enthalpy change is ascertained using a specified heat load.

16. The method of claim 9 wherein the enthalpy change is ascertained using the actual heat load.

* * * * *